United States Patent [19]

Cornelius et al.

[11] Patent Number: 4,499,438

[45] Date of Patent: Feb. 12, 1985

[54] HIGH FREQUENCY ATTENUATION CORE AND CABLE

[75] Inventors: Rajendra S. Cornelius, Palo Alto; Albert R. Martin, Oakland; Hans E. Lunk, Menlo Park; Mark D. Mendenhall, Fremont, all of Calif.

[73] Assignee: Raychem Corporation, Menlo Park, Calif.

[21] Appl. No.: 417,954

[22] Filed: Sep. 14, 1982

Related U.S. Application Data

[63] Continuation-in-part of Ser. No. 328,346, Dec. 7, 1981.

[51] Int. Cl.[3] ..... H01P 3/00; H01B 11/06

[52] U.S. Cl. ..... 333/1; 174/36; 174/103; 174/106 R; 333/12; 333/236; 333/243

[58] Field of Search ..... 333/1, 12, 206, 236, 333/81 A, 243; 174/36, 103, 106 R; 178/45

[56] References Cited

U.S. PATENT DOCUMENTS

| | | | |
|---|---|---|---|
| 2,622,152 | 12/1952 | Rosch | 333/243 |
| 3,541,473 | 11/1970 | Schlicke et al. | 333/243 X |
| 4,301,428 | 11/1981 | Mayer | 333/243 X |
| 4,342,880 | 8/1982 | Castelli et al. | 174/36 |
| 4,347,487 | 8/1982 | Martin | 333/243 X |
| 4,371,742 | 2/1983 | Manly | 333/243 X |
| 4,383,225 | 5/1983 | Mayer | 333/243 X |

*Primary Examiner*—Paul L. Gensler

*Attorney, Agent, or Firm*—Ira D. Blecker; James W. Peterson; Herbert G. Burkard

[57] ABSTRACT

Disclosed is a high frequency attenuation core and cable. The core includes a conductor surrounded by a high frequency energy absorbing medium, then surrounded by a dielectric, and then surrounded by an outer layer made from a material having a high complex dielectric constant. The cable includes the above described core surrounded by an electromagnetic interference (EMI) shield which is further surrounded by a conductive layer. The cable and core as described above may be used in harness applications wherein a plurality of cores and/or cables as described above are surrounded by a gross shield. In addition, when the cores described above are used in multi-core applications, they may individually include an additional EMI shield for greater electromagnetic interference protection.

12 Claims, 9 Drawing Figures

HIGH FREQUENCY ATTENUATION CORE AND CABLE

CROSS-REFERENCE TO RELATED APPLICATION

This application is a continuation-in-part of our copending application Ser. No. 328,346 filed Dec. 7, 1981, the disclosure of which is incorporated herein by reference.

BACKGROUND OF THE INVENTION

The use of high frequency attenuation cables has sharply increased in recent times. High frequency attenuation cables which also protect against electromagnetic interference (hereinafter EMI) are especially desireable for military applications. Light weight, labor efficient high frequency attenuation cables are especially valuable for use on board fixed wing aircraft and helicopters and the like.

There have been many high frequency attenuation cables in the past. The more relevant of these structures are discussed in commonly assigned U.S. patent application Ser. No. 210,202, now U.S. Pat. No. 4,347,487 (hereinafter Martin) which is incorporated herein by reference. Martin discloses a high frequency attenuation cable having an EMI shield, which when bundled with other similar cables eliminates most sneak path problems. It is well established that sneak paths dilute the effectiveness of high frequency attenuation. In typical multi-conductor or harness applications of high frequency attenuation cables having an EMI shield, a sneak path is created between adjacent cables' EMI shields and their surrounding dielectric. The sneak path allows high frequency energy filtered by the respective cable's attenuation layer to jump from the attenuation layer and travel aong the EMI shield.

Martin is directed toward eliminating the problem of sneak paths in multi-conductor or harness cables. Martin discloses a structure having a standard core for high frequency attenuation cables consisting of a conductor surrounded by a high frequency attenuation medium, and a dielectric layer which further surrounds the attenuation medium. Martin further includes the standard core surrounded by an EMI shield, which is further surrounded by a conductive outer layer. The conductive outer layer acts to cancel sneak paths of multi-conductor or harness cables by shorting out the sneak paths of known core consisting of a central conductor of each high frequency attenuation cable against the other cable's conductive outer layer. The individual cable in accordance with Martin does not in itself produce better high frequency attenuation efficiently than previously known high frequency attenuation cables. Rather, when Martin cables are combined in a multi-conductor or harness applications, the resultant structure retains almost all the high frequency attenuation efficiency of the individual cable which it would otherwise lose due to sneak paths.

The instant invention discloses a particularly high performance, high frequency attenuation core. The core of the cable being that portion of the cable surrounded by the EMI layer, as will be explained more fully hereinafter. The individual core of the instant invention includes an additional layer of material surrounding the dielectric of the known core. The additional layer is preferably conductive but must at least possess the property of having a high complex dielectric constant (e.g. $\Sigma > 11$).

The instant invention, in one embodiment, utilizes the discoveries set forth in Martin for producing a particularly good EMI shielded multi-core cable. In that embodiment, the individual core members each are surrounded by an EMI shield. The instant invention also includes another embodiment, wherein a gross shield is wrapped around a plurality of the above described cores to produce a light-weight, labor efficient cable.

SUMMARY OF THE INVENTION

A first embodiment of the instant invention is a high frequency attenuation cable core including a conductor surrounded by a high frequency absorption medium for attenuating high frequency energy propagating through the cable, the absorption medium is surrounded by a dielectric, and an outer layer made of material having a high complex dielectric constant surrounds the dielectric.

An alternative embodiment of the instant invention includes the new core, described above, further surrounded by an EMI shielding layer. The EMI shielding layer is further surrounded by a conductive layer as disclosed by Martin.

The new core described above may be used in multi-core applications, wherein at least two cores are surrounded by a gross EMI shield which is in turn surrounded by a protective outer covering. This embodiment is similar to the multi-conductor embodiment of Martin. However, considerable mass savings is achieved by the instant invention since each core does not have an individual EMI shield. Additionally, the field technician installing the instant invention does not have to terminate individual EMI shields, thereby making this embodiment of the instant invention considerably more labor efficient than Martin.

A less flexible and more massive alternate embodiment of a harness-type cable in accordance with this invention includes the new cores as described above in the alternative embodiment, each being individually EMI shielded. To prevent sneak paths, each new core is further surrounded by a conductive layer as disclosed in Martin. The individual core attentuation efficiency of this embodiment is no better than the first embodiment. However, the EMI shielding is considerably better.

When the new core includes an outer layer of conductive material which also has a high dielectric constant, to new core attenuation efficiency is improved. However, non-conductive or semi-conductive material which has a high complex dielectric constant can be used for the outer layer of the new core with acceptable results for certain applications.

These and other advantages and objects of the instant invention will become apparent more fully hereinafter with reference to the accompanying Drawings in which:

DETAILED DESCRIPTION OF THE INVENTION

Figure 1:
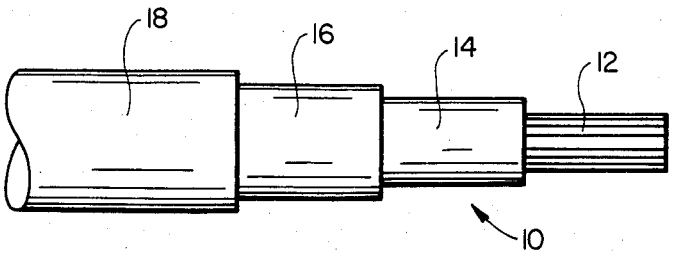
FIG. 1 illustrates one embodiment of the instant invention, a high frequency attenuation cable core in partial cross-section.

With reference to the Drawing wherein like reference characters designate like or corresponding parts throughout the several views and referring particularly to FIG. 1 there is shown a high frequency attenuation cable core in accordance with this invention generally denoted by the numeral 10.

For the purposes of this application, a cable may be divided into two parts, an inner part called hereinafter a core and an outer part having EMI shield as well as additional outer layers. The instant invention is an improvement to the inner part or core which includes certain advantages when that core is used in cables of the type discussed herein. The instant invention includes an additional layer surrounding the standard core which is material having a high dielectric constant ($\Sigma$ at least as great as 11) and which is preferably conductive.

The new core 10 includes a central conductor 12, a high frequency energy attenuation medium 14 surrounding the conductor 12, a dielectric (or insulation means) 16 surrounding the high frequency energy absorption medium 14 and an outer layer 18 which is conductive and has a high complex dielectric constant surrounding the dielectric 16. The core 10 has been found to increase high frequency attenuation efficiency over previously known cores by at least 15 percent over the more important frequency range for high frequency attenuation cables. A graphic comparison of the new core 10 with a known core consisting of a central conductor, a high frequency energy attenuation medium and dielectric will be discussed more fully hereinafter.

Figure 3:
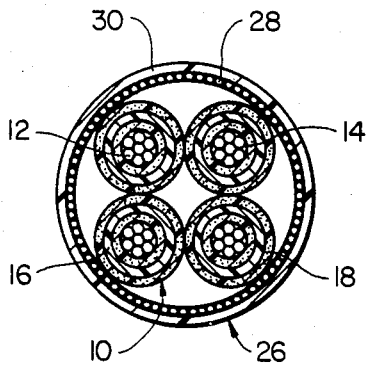
FIG. 3 illustrates one alternative of a multi-core cable having a gross shield surrounding cores in accordance with FIG. 1.
Figure 4:
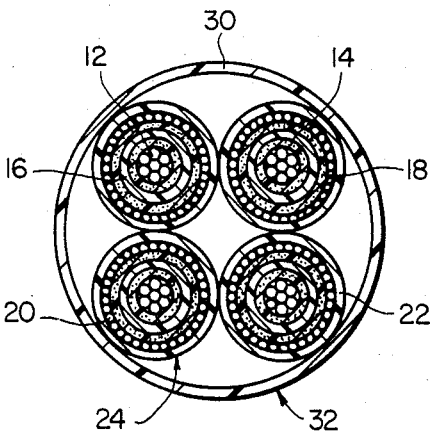
FIG. 4 illustrates an embodiment of a multi-conductor cable in accordance with this invention.

The conductor 12 may be a single filament, a solid conductor or a group of filaments or similar structure. Additionally, as will be discussed hereinafter, the cable may be a multi-core cable as shown in FIGS. 3 and 4.

The high frequency energy attenuation medium 14 may be of any suitable material. It has been found that lossy material such as that described in U.S. Pat. Nos. 3,309,633 and 3,191,132 are particularly useful in absorbing high frequency energy. Applicant incorporates herein by reference those parts of the above references which disclose high frequency energy absorbing media.

More generally, the attenuation medium should be primarily of high magnetic permeability and secondarily of low chemical activity, as explained in Martin which is incorporated herein by reference. Ferrite loaded polymer is the preferred composition for the attenuation medium.

The preferred material for the attenuation medium 14 is filled elastomer. The high frequency energy is absorbed by the spin wave system, but low frequency energy passes unaffected. As the imaginary part of the magnetic permeability increases with frequency, the attenuation medium 14 becomes more effective at filtering the higher frequencies. Examples of such material include elastomer filled with ferrite or iron alloys.

Dielectric 16 surrounds the attenuation medium 14 to provide chemical resistance and a layer of high electrical resistance which aids the conductor 12 to function more efficiently. The attenuation medium 14 may be quite conductive and without the dielectric 16 surrounding the attenuation medium 14 there may be insufficient resistance resulting in inefficient operation of the central conductor. This phenomena is especially apparent in high voltage usage. The dielectric is made of Tefzel® (registered trademark of E. I. duPont de Nemours & Company) which has been found by experimentation and analysis to be quite effective. Other similar materials could, of course, be used.

The outer layer 18 forms the outermost element of the new core 10 and surrounds the dielectric 16. The layer is conductive and has a high complex dielectric constant, which here is at least 13. The conductive material increases the attenuation of the core by: a. reducing the phase velocity, which increases the effective length of the core, and hence the attenuation, which is proportional to length of the core; and by: b. increasing the volume of lossy material in the core. Polymers filled with ferrite have a complex dielectric constant ($\Sigma$) equal to 13. This material is generally considered conductive. The instant invention includes embodiments having an outer layer 18 which is not necessarily conductive. As long as the outer layer is made from material having a high complex dielectric constant, wherein $\Sigma$ is at least 11, the amplitude and phase of the wave passing therethrough will be sufficiently attenuated for some applications of this invention. Capacitor-type materials and particularly Barium titanate and Aluminum, which may be flaked or otherwise loaded into an elastomer to form the outer layer 18 are examples of this type of material.

Figure 2:
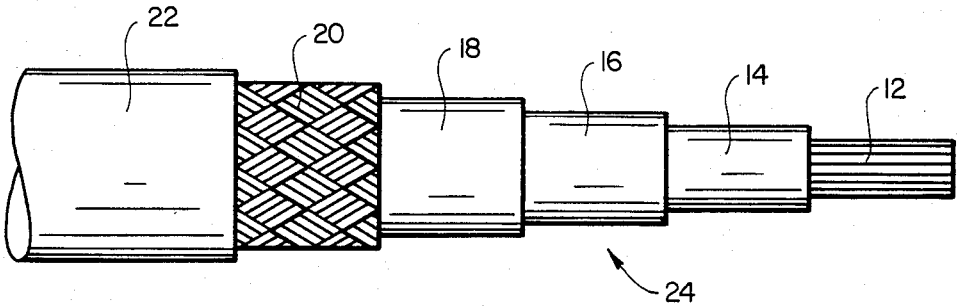
FIG. 2 illustrates another embodiment of the instant invention, a high frequency attenuation cable having the core of FIG. 1.

Often it is desirable to combine a new core 10 into a multi-core or harness cable, wherein each core 10 includes an EMI shielding layer 20. As illustrated in FIG. 2 and as taught by Martin, the instant invention may be wrapped with an EMI shielding layer 20 and an outer conductive layer 22. The resultant high frequency attenuation cable 14 may be used in a multi-conductor or harness-type cable as illustrated in FIG. 4 without significantly decreased attenuation efficiency.

With particular reference to FIG. 3 there is seen a high frequency attenuation multi-core cable 26 having a plurality of new cores 10. The new cores 10 are surrounded by a gross EMI shielding layer 28 and the EMI shield is surrounded by a protective layer 30. Since the individual new core 10 has a higher attenuation efficiency than a standard core, the resultant multi-core cable 26 even without individual EMI shields performs acceptably for many applications.

The multi-core cable 26 has significant advantages. The cable 26 is significantly lighter (less massive) and more flexible than other acceptable cables, since it uses a single gross shield 28 surrounding the new cores 10, rather than a plurality of shields on the individual cores. Additionally, the cable 26 is labor efficient since there are no individual EMI shielding layers to be terminated.

Thus, the instant invention provides a multi-core high frequency attenuation cable which meets may performance requirements while being light weight and labor efficient.

With particular reference to FIG. 4, there is seen a multi-conductor cable in accordance with this invention generally indicated by the numeral 32. The cable 32 includes individual cable members 24. The cable 32 utilizes the disclosure made in Martin as previously set forth. Members 24 are arranged in the configuration shown in FIG. 4 to create a multi-conductor cable. An outer protective layer 30 is then wrapped around the members 11. It will be appreciated, although it is not shown, that an additional shielding layer such as 28 may be disposed between the cable members 24 and the outer layer 30 for additional EMI shielding.

While the cable 32 is a particulary high performance cable with respect to EMI shielding, it will be appreciated that since the individual members 24 include shielding 20 and an extra conductive layer 22, the cable 32 may be too heavy (massive) and too inflexible for some applications. Additionally, each member 24 must have its shielding layer 20 terminated to insure proper EMI shielding and attenuation results, thereby making the cable 32 more labor expensive than cable 26. Thus, the labor and weight savings achieved in the earlier embodiment of the multi-core cable 26 are not available in the multi-conductor cable 32. However, the EMI shielding performance difference between the cables 26 and 32 may offset these added labor and weight costs for certain applications.

Figure 5:
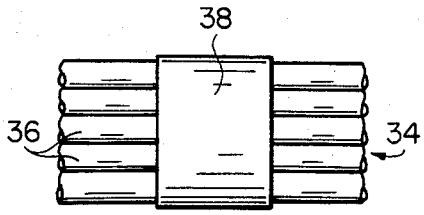
FIG. 5 illustrates in perspective a harness-type cable in accordance with this invention.

With particular reference to FIG. 5 there is seen a wire harness generally denoted by the numeral 34 comprising a plurality of high frequency attenuation cables 36. As will be appreciated the cables 36 may be of any of the type previously described, i.e. 10, 24, 26 or 32. The cables 36 may be the new core 10 by itself, the high performance EMI shielded cable 124, or the multi-core cables 26 or multi-conductor cables 32 depending on application requirements. The cables 36 are held in place by a suitable holding means 38.

While the preferred embodiment of applicant's new core 10 includes an outer conductive layer 18, it has been found that the outer layer 18 need not be conductive as long as the layer has a high complex dielectric constant. As is known, dielectric materials are those materials which affect both the phase and the amplitude of waves attempting to propagate therethrough. Also, as is known, a complex number has two parts, a real part and an imaginary part ($\sqrt{-1}$). A complex dielectric constant, likewise, is a number (a constant) with a real and an imaginary part. The magnitude of the combination of the real and imaginary parts of a dielectric material determine the extent to which a wave propagating therethrough is affected. For the purposes of attenuating high frequency in accordance with this invention, it is preferred that the complex dielectric constant be as high as possible.

Figure 6:
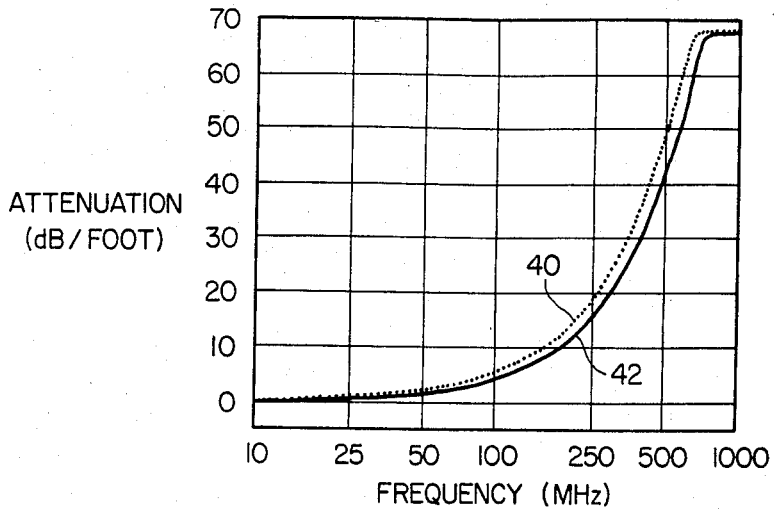
FIG. 6 is an actual graphic comparison of a standard core with the core in accordance with this invention.

With respect to FIG. 6 there is shown an actual graphic comparison of the new core 10 with an old core. The new core 10 was made to Specification 55FA0111 published by Raychem Corporation (which is incorporated herein) and included an approximate 6 mil layer of carbon black loaded Tefzel which was radiation cross-linked surrounding the dielectric of the above referenced Specification. The old core consisted of the core shown in Specification 55FA0111. The samples are both two feet long. As will be appreciated, the new core represented by line 40 is significantly better than the old core, represented by line 42 along the most important parts of the frequency range, namely between 50 megahertz (MHz) and 500 megahertz (MHz). The new core 10 is approximately 15 percent more efficient.

Figure 7:
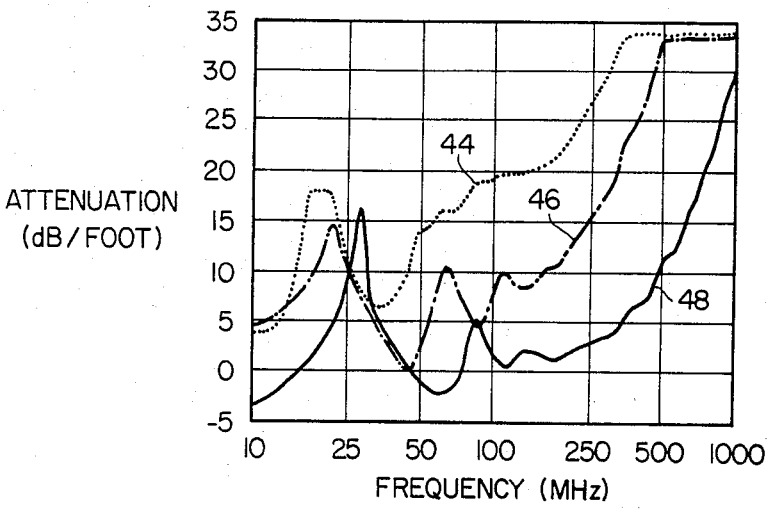
FIG. 7 is an actual graphic comparison of various multi-core and multi-conductor cables.

With particular reference to FIG. 7, there is shown an actual comparison of a construction of the multi-core cable 26 with a multi-conductor embodiment of Martin and a multi-old core embodiment having a gross shield. The multi-core cable 26 consisted of a 19 member bundle, each member consisted of a new core having the first three layers made to Raychem Specification 55FA0211-20, which is incorporated herein by reference, surrounded by an approximate 6 mil layer of carbon black loaded Tefzel which was radiation cross-linked. The members were bundled in a 12-6-1 configuration. An overall tin copper braid was applied to the core and a jacket material made according to Raychem RNF-100 Specification (which is incorporated herein) was shrunk over the braid.

The multi-conductor embodiment of Martin consisted of a 19-member bundle; each member was made to Raychem Specification 55FB1211-20, which is incorporated herein, bundled in a 12-6-1 configuration and was surrounded by an overall tin-copper EMI shield and an RNF-100 jacket was shrunk over the braid.

The multi-old core with gross shield embodiment consisted of a 19-member bundle, each member being made to Raychem Specification 55FA0211-20, which is incorporated herein, bundled in a 12-6-1 configuration. An overall tin-copper EMI shield surrounded the members and an RNF-100 jacket was shrunk over the shield.

All the samples were two-foot long. The multi-core cable 26 sample is represented by line 44, the multi-conductor Martin sample is represented by line 46 and the multi-old core with gross shield embodiment sample is represented by line 48.

As can be seen throughout the more important frequency ranges for high-frequency attenuation cables, the multi-core cable 26 significantly outperforms the other samples. At 100 MHz, the old core with gross shield has an attenuation efficiency of approximately 2.5 dB, while the Martin has an efficiency of approximately 7.5 dB and the multi-core cable 26 has an attenuation efficiency of approximately 17.5 dB. Similarly, throughout the most important frequency range, the multi-core cable 26 significantly outperforms the other samples.

It should be noted that beyond 500 MHz where line 44 flattens out the test equipment has insufficient sensitivity to allow comparisons. The multi-core cable 26 outperforms the limits of the test equipment used in measuring the attenuation efficiency.

Figure 8:
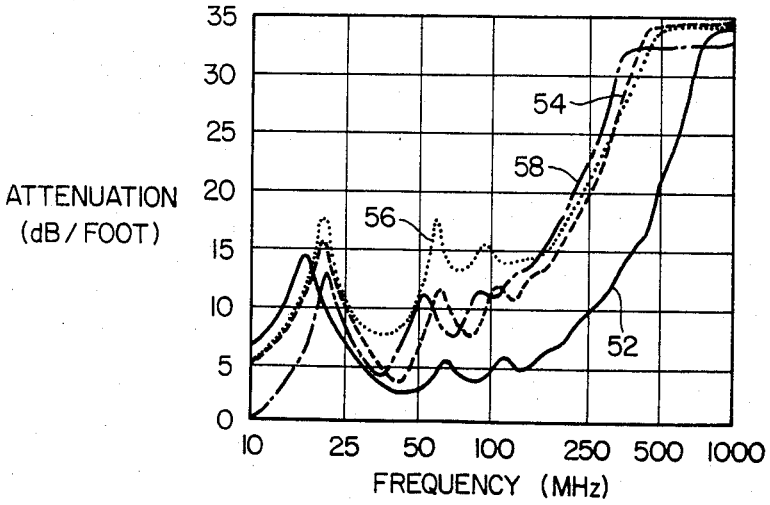
FIG. 8 is an actual graphic comparison of multi-core and multi-conductor cables in accordance with this invention and multi-conductor cables in accordance with Martin.

With particular reference to FIG. 8 there is seen an actual graphic comparison of four high frequency attenuation cable samples. Line 52 represents a multi-core embodiment of Martin wherein the individual members are not EMI shielded. This Martin sample consisted of a 7 member bundle of 55FA0111-20 in a 6-1 configuration with a gross overall EMI shield of tin copper surrounded by an RNF-100 jacket shrunk over the shield.

Line 54 represents Martin with the individual members being shielded. This sample consisted of a 7 member bundle, where each bundle was made to Raychem Specification 55FB111-20, which is incorporated herein, bundled in a 6-1 configuration with a gross overall braid of tin copper and surrounded by an RNF-100 jacket shrunk over the EMI shield.

Line 56 represents a sample of multi-conductor cable 32. This is a 7 member bundle, each member being made to 55FA0111-20 surrounded by an approximate 6 mil layer of carbon black loaded Tefzel which was radiation cross-linked with a gross overall braid of tin copper and surrounded by a RNF-100 jacket which was shrunk over the EMI shield.

Line 58 represents a sample of multi-core cable 26. The sample consisted of a 7 member bundle, each member being made to Raychem Specification 55FA0111-20, surrounded by an approximate 6 mil layer of carbon black loaded Tefzel which was radiation cross-linked, further surrounded by a tin copper EMI shield and an RNF-100 jacket was shrunk down over the EMI shield. The members were surrounded by a gross overall EMI shield of tin copper and an RNF-100 jacket was shrunk over the EMI shield.

Each of the samples were two feet long. As can be seen throughout the more important frequency range (50 MHz–500 MHz), lines 54 and 56 are approximately equal when the errors caused by test equipment to sample impedance mismatches and the limits of the test equipment are removed. As can be seen, line 58 is considerably better than line 54, approximately 15%, over the more important frequency range (500 MHz–500 MHz).

Line 52 shows that the multi-core Martin sample is significantly inferior to the other three samples tested. However, it should be pointed out that as the number of elements in the cable increase, the attenuation of the cores having a gross shield has been found experimentally to increase. In the case where each individual core member is shielded this is not so because the results of the individual core member attenuation efficiency are not additive.

More importantly the graph of FIG. 8 shows that the multi-core cable 26 with a gross shield produces acceptable attenuation efficiency. It should be noted, as earlier discussed, that cable 26 has particular mass and labor savings which make this embodiment particularly advantageous.

Figure 9:
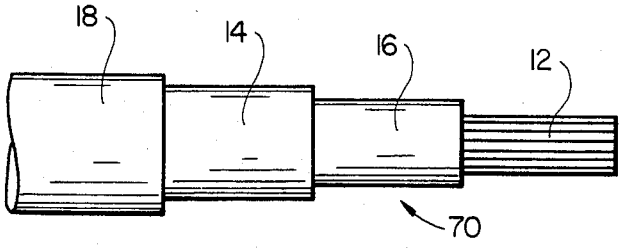
FIG. 9 illustrates an alternative embodiment of the instant invention in which the high frequency energy attenuation medium layer and the dielectric layer as illustrated in FIG. 1 are now reversed.

Alternatively, it has been found that the layers 14 and 16 can be reversed with little or no effect on the overall electrical performance of the core. With particular reference to FIG. 9, there is seen another embodiment of the new core, generally indicated by the numeral 70. This new core 70 includes the central conductor 12, the high frequency energy attenuation medium 14 surrounding the dielectric 16 and the outer layer 18 surrounding the high frequency energy attenuation medium 14.

While there is little or no effect on the core's electrical performance as a result of the above construction, there is considerable improvement in the mechanical performance of core 70. The construction of core 70 allows the user to "step-strip" the outer layer 18 and medium 14 while minimizing the danger of accidentally cutting the dielectric 16. When the dielectric 16 is cut it tends to split and crack, destroying its electrical and mechanical effectiveness.

Of course, core 70 may be used in a harness precisely the same as core 10. Additionally, if desirable a harness may contain a mixture of cores 10 and 70.

While the instant invention has been described by reference to what is believed to be the most practical embodiments, it is understood that the invention may embody other specific forms not departing from the spirit of the invention. It should be understood that there are other embodiments which possess the qualities and characteristics which would generally function in the same manner and should be considered within the scope of this invention. The present embodiments therefore should be considered in all respects as illustrative and not restrictive, the scope of the invention being limited solely to the appended claims rather than the foregoing description and all equivalents thereto being intended to be embraced therein.

What is claimed:

1. A high frequency attenuation cable core, comprising:

at least one conductor;

dielectric surrounding the conductor;

a high frequency energy absorption medium for attenuating high frequency energy propagating through the core in use, the absorption medium surrounding the dielectric; and an outer layer made from material having a high complex dielectric constant directly surrounding the absorption medium, said outer layer being made from a titanate loaded polymer.

2. A high frequency attenuation cable core, comprising:

at least one conductor;

dielectric surrounding the conductor;

a high frequency energy absorption mdium for attenuating high frequency energy propagating through the core in use, the absorption medium surrounding the dielectric; and an outer layer made from material having a high complex dielectric constant directly surrounding the absorption medium, said outer layer being made from a carbon black loaded Tefzel.

3. A high frequency attenuation cable core, comprising:

at least one conductor;

dielectric surrounding the conductor;

a high frequency energy absorption medium for attenuating high frequency energy propagating through the core in use, the absorption medium surrounding the dielectric; and an outer layer made from material having a high complex dielectric constant directly surrounding the absorption medium, said outer layer being made from a ferrite loaded polymer.

4. A high frequency attenuation cable core, comprising:

at least one conductor;

dielectric surrounding the conductor;

a high frequency energy absorption medium for attenuating high frequency energy propagating through the core in use, the absorption medium surrounding the dielectric; and an outer layer made from material having a high complex dielectric constant directly surrounding the absorption medium, said outer layer being made from an aluminum loaded polymer.

5. A high frequency attenuation harness comprising: a plurality of high frequency attenuation cores, wherein each core comprises:

at least one conductor;

dielectric surrounding the conductor;

a high frequency energy absorption medium for attenuating high frequency energy propagating through the core in use, the absorption medium surrounding the dielectric; and an outer layer made from material having a high complex dielectric constant directly surrounding the absorption medium, said outer layer being made from a titanate loaded polymer; and the plurality of cores surrounded by a common EMI shielding for preventing EMI from entering the cores.

6. A high frequency attenuation harness comprising: a plurality of high frequency attenuation cores, wherein each core comprises:

at least one conductor;

dielectric surrounding the conductor;

a high frequency energy absorption medium for attenuating high frequency energy propagating through the core in use, the absorption medium surrounding the dielectric; and an outer layer made from material having a high complex dielectric constant directly surrounding the absorption medium, said outer layer being made from a carbon black loaded Tefzel; and the plurality of cores surrounded by a common EMI shielding for preventing EMI from entering the cores.

7. A high frequency attenuation harness comprising: a plurality of high frequency attenuation cores, wherein each core comprises:

at least one conductor;

dielectric surrounding the conductor;

a high frequency energy absorption mdium for attenuating high frequency energy propagating through the core in use, the absorption medium surrounding the dielectric; and an outer layer made from material having a high complex dielectric constant directly surrounding the absorption medium, said outer layer being made from a ferrite loaded polymer; and the plurality of cores surrounded by a common EMI shielding for preventing EMI from entering the cores.

8. A high frequency attenuation harness comprising: a plurality of high frequency attenuation cores, wherein each core comprises:

at least one conductor;

dielectric surrounding the conductor;

a high frequency energy absorption medium for attenuating high frequency energy propagating through the core in use, the absorption medium surrounding the dielectric; and an outer layer made from material having a high complex dielectric constant directly surrounding the absorption medium, said outer layer being made from an aluminum loaded polymer; and the plurality of cores surrounded by a common EMI shielding for preventing EMI from entering the cores.

9. A high frequency attenuation harness comprising: a plurality of high frequency attenuation cables wherein each cable includes:

a core having at least one conductor;

dielectric surrounding the conductor; and a high frequency absorption medium for attenuating high frequency energy passing through the cable in use, the absorption medium surrounding the dielectric;

an outer layer made from material having a high complex dielectric constant directly surrounding the absorption medium, said outer layer being made from a titanate loaded polymer; and EMI shielding means for preventing EMI from entering the cores surrounding each core; and an electrically conductive outer layer surrounding each EMI shielding means;

the plurality of cables being surrounded by a protective outer jacket.

10. A high frequency attenuation harness comprising: a plurality of high frequency attenuation cables wherein each cable includes:

a core having at least one conductor;

dielectric surrounding the conductor; and a high frequency absorption medium for attenuating high frequency energy passing through the cable in use, the absorption medium surrounding the dielectric;

an outer layer made from material having a high complex dielectric constant directly surrounding the absorption medium, said outer layer being made from a carbon black loaded Tefzel; and EMI shielding means for preventing EMI from entering the cores surrounding each core; and an electrically conductive outer layer surrounding each EMI shielding means;

the plurality of cables being surrounded by a protective outer jacket.

11. A high frequency attenuation harness comprising: a plurality of high frequency attenuation cables wherein each cable includes:

a core having at least one conductor;

dielectric surrounding the conductor; and a high frequency absorption medium for attenuating high frequency energy passing through the cable in use, the absorption medium surrounding the dielectric;

an outer layer made from material having a high complex dielectric constant directly surrounding the absorption medium said outer layer being made from a ferrite loaded polymer; and EMI shielding means for preventing EMI from entering the cores surrounding each core; and an electrically conductive outer layer surrounding each EMI shielding means;

the plurality of cables being surrounded by a protective outer jacket.

12. A high frequency attenuation harness comprising: a plurality of high frequency attenuation cables wherein each cable includes:

a core having at least one conductor;

dielectric surrounding the conductor; and a high frequency absorption medium for attenuating high frequency energy passing through the cable in use, the absorption medium surrounding the dielectric;

an outer layer made from material having a high complex dielectric constant directly surrounding the absorption medium, said outer layer being made from an aluminum loaded polymer; and EMI shielding means for preventing EMI from entering the cores surrounding each core; and an electrically conductive outerlayer surrounding each EMI shielding means;

the plurality of cables being surrounded by a protective outer jacket.

* * * * *